United States Patent [19]

Vosper

[11] 4,448,160

[45] May 15, 1984

[54] FUEL INJECTOR

[76] Inventor: George W. Vosper, 140 Earl St., Kingston, Ontario, Canada, K7L 2H3

[21] Appl. No.: 358,011

[22] Filed: Mar. 15, 1982

[51] Int. Cl.[3] ..... F02M 57/06

[52] U.S. Cl. ..... 123/297; 123/527; 123/25 C; 123/169 PA; 123/525

[58] Field of Search ..... 123/25 A, 266, 297, 123/299, 305, DIG. 12, 169 PA, 169 PH, 169 PB, 25 C, 304, 25 D, 527, 525

[56] References Cited

U.S. PATENT DOCUMENTS

| | | | |
|---|---|---|---|
| 1,491,376 | 4/1924 | Bochet | 123/25 E |
| 3,983,882 | 10/1976 | Billings | 123/25 A |
| 4,095,580 | 6/1978 | Murray et al. | 123/297 |
| 4,343,272 | 8/1982 | Buck | 123/297 |
| 4,346,682 | 8/1982 | Mader | 123/527 |
| 4,351,300 | 9/1982 | Selvidge et al. | 123/527 |

FOREIGN PATENT DOCUMENTS

| | | | |
|---|---|---|---|
| 2851232 | 7/1969 | Fed. Rep. of Germany | 123/25 A |
| 263529 | 12/1926 | United Kingdom | 123/25 |

*Primary Examiner*—Craig R. Feinberg
*Assistant Examiner*—David A. Okonsky
*Attorney, Agent, or Firm*—Lowe, King, Price & Becker

[57] ABSTRACT

An automobile spark plug having fluid flow passages therein for injecting a fuel mixture into the combustion chamber of an internal combustion engine. The spark plug has a central electrode with an ignitor tip at one end thereof and surrounded by concentric fluid flow passages. Liquid atomizing orifice means interconnect the passages and the mixture therefrom flows into a passage surrounding the ignitor tip of the electrode. A gas and liquid mixture (preferably hydrogen with water) are proportioned in response to the quantity of one of the two dispensed.

14 Claims, 5 Drawing Figures

FUEL INJECTOR

This invention relates generally to internal combustion engines and more particularly to a fuel injector wherein a liquid is atomized using gas and means are provided for use in igniting the fuel.

Internal combustion engines commonly operate on fuel/air mixtures suitably supplied by way of a carburetion system or fuel injectors. Where the combustible fuel is gasoline, a suitable air fuel mixture is provided by a carburetor with metering jets to meter the fuel into air flowing through the carburetor into an intake manifold. An alternative system utilizes injectors for injecting the fuel directly into the combustion chamber and normally includes a pump, filters and fuel injectors.

In each instance fuel igniting devices are used (sparking plugs) to ignite the fuel in the combustion chambers of the engine.

An object of the present invention is to provide a combined fuel injector and ignitor for a combustion engine.

There is disclosed in U.S. Pat. No. 4,215,979, issued Aug. 5, 1980 to Tera Morishita, an ignition torch for a gas turbine which on first impression may appear similar to Applicant's device, but is quite different. The patented structure is a torch with a continuous flame for igniting a combustible fuel supplied by other means to the combustion chamber. In the present invention, the fuel for combustion is supplied to the combustion chamber of the engine by the injector having also associated therewith an ignitor for the fuel.

Another object of the present invention is to provide a fuel injector having passages to atomize a liquid using a gas to do so and including means to ignite the fuel injected.

Another object of the present invention is to provide an injector for use with hydrogen as the fuel in internal combustion engines. While hydrogen is the preferred fuel, the present device, as will become more apparent hereinafter, can be used with other fuels. When using hydrogen as a fuel it is desirable to mix water therewith to suppress or eliminate, if possible, the formation of nitrous oxides. The water vapor in the combustion chamber lowers the flame temperature during combustion to accomplish this. The present practice when using hydrogen as a fuel is to use a carburetor to vaporize the water. In such arrangement there is throttling on the intake and this reduces efficiency.

Another object of the present invention is to provide a novel construction for a screw-in device that has concentric annular fluid-flow passages therethrough.

In accordance with one aspect of the present invention, there is provided a combination fuel injector and ignitor for an internal combustion engine comprising: (a) a body member threaded at one end thereof for screwing into a spark plug hole of an internal combustion engine, (b) an electrode mounted in said body member and having a tip portion adjacent the threaded end for igniting fuel in the combustion chamber of the engine and including means to connect the electrode to a suitable ignition electrical distribution system of the engine, (c) first and second annular concentric fluid flow passageways in said body member surrounding said electrode and having respective first and second individual inlets thereto, and (d) fluid atomizing means connecting said passages with a common passage having an outlet therefrom in the combustion chamber of the engine when the injector is threaded into the spark plug hole.

In accordance with another aspect of the present invention, there is provided an elongate body having a central passageway extending therethrough and threaded at one end thereof for screwing into a threaded hole, a central elongate member extending axially along said passageway and having an outwardly projecting circumferential rib, said rib being spaced from a shoulder in said passageway, an annular nozzel means abutting respectively said rib and shoulder and having respective first and second passages, sleeve means in said passageway providing two concentric annular fluid-flow passages therethrough and communicating respectively with the first and second passages of said nozzle means, an annular nut threaded ino said elongate body at an end thereof opposite said one end and a tube abutting at one end thereof against an end of said nut and at the other end against said rib on the central elongate member, said tube being of stepped diameter and having apertured portions traversing said first and second annular fluid-flow passages.

The invention is illustrated by way of example in the accompanying drawings wherein.

Figure 1:
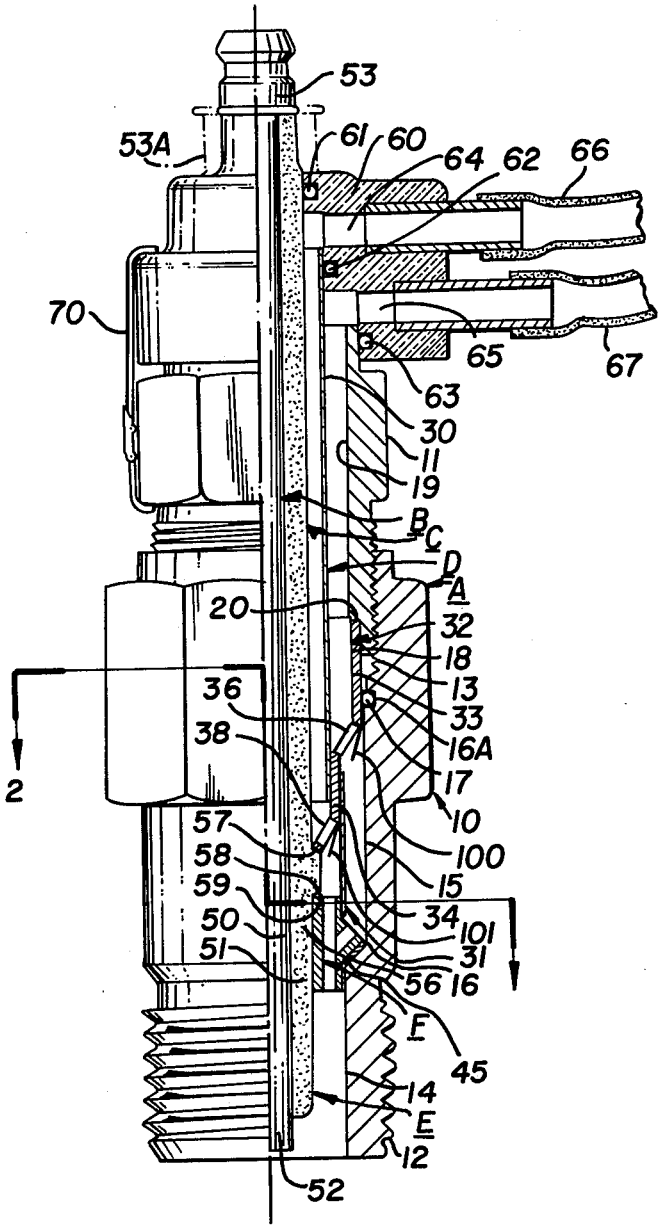
FIG. 1 is an elevational, partial sectional view of the combined fuel injector and ignitor provided in accordance with the present invention.
Figure 2:
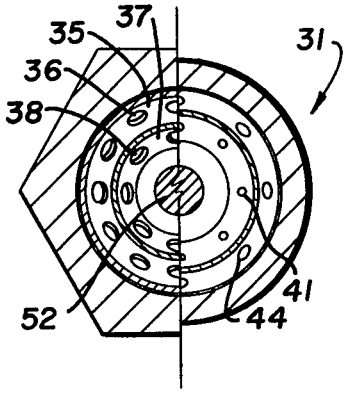
FIG. 2 is a stepped cross-sectional view taken along stepped line 2—2 in FIG. 1.

Referring now in detail to the drawings, there is illustrated in FIG. 1 a combined fuel injector and ignitor provided in accordance with the present invention consisting basically of a rigid body member A, an insulated electrode B, and concentric fluid flow passages C and D separated from a continuing common passage E by way of a fluid atomizing element F.

The body A comprises a main portion 10 and a nut portion 11 threaded thereinto. The main body portion has an externally threaded end portion 12 for screwing into the spark plug hole of an internal combustion engine and an internally threaded opposite end 13 for receiving the nut 11. The body member 10 has a first internal axial bore or passage 14, providing the previously described common passage E and a second larger diameter axial bore 15, one being joined to the other by way of a sloping wall 16. Adjacent the upper end of the bore portion 15 there is a groove **16*a* for receiving an annular O-ring seal 17**.

The nut 11 has a first axial bore portion 18 corresponding essentially in diameter to the bore 15 in the body 10, a second axial bore portion 19 of somewhat smaller diameter than bore 18 and a shoulder 20 located at the juncture of the bores 18 and 19.

Located within the injector are first and second sleeves 30 and 31, sleeve 30 being of smaller diameter than sleeve 31 and having a lower end portion thereof projecting into an upper end portion of sleeve 31 whereby the adjacent end portions of the sleeves partially overlap one another. The partially overlapping portions of the sleeves are separated by a portion of a tube 32.

The tube 32 includes first and second respective portions 33 and 34 interconnected by a truncated conical portion 35 in which there are a plurality of apertures or orifices 36. Tube portion 34 accordingly is of smaller diameter than the tube portion 33 and at the end of tube portion 34 there is a truncated conical portion 37 having a plurality of apertures or orifices 38 therein.

The outer diameter of the tube portion 33 is such, as will be seen from FIG. 1, as to fit in the axial bore 15 of the body 10 in sealing engagement with the O-ring 17 and the end of such sleeve portion abuts against the shoulder 20 located at the juncture of the axial bores 18 and 19 in the nut 11. The apertures 36 provide a fluid flow path from the axial bore 19 in the nut to the axial bore 15 in the body member 10.

The sleeve portion 34 is interposed between the overlapping portions of sleeves 30 and 31, the diameters of the respective sleeves and wall thickness of portion 34 being such that the components are interengaged with one another in press fitting relation.

Figure 3:
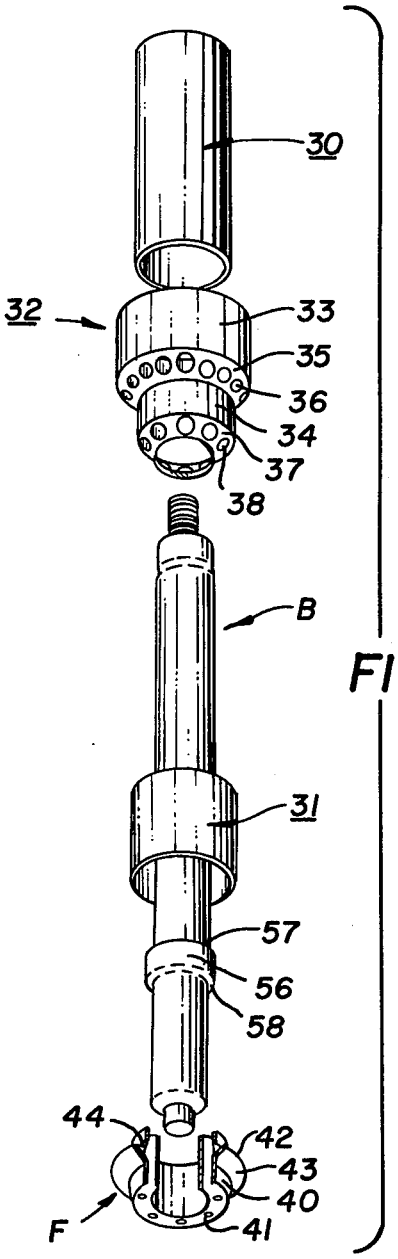
FIG. 3 is an exploded view illustrating some of the components of the fuel injector and ignitor.

The fluid atomizing element F has an end portion thereof inserted in an end portion of the sleeve 31 in tight press fit relation and, as will be clearly seen from FIG. 3, consists of an open-ended sleeve 40 having a plurality of through apertures or orifices 41 parallel to the axis thereof and a rib 42 projecting outwardly from the outer surface. The rib 42 has a sloped surface 43 corresponding to the sloped shoulder 16 connecting axial bore portions 14 and 15 in the main body 10. In the atomizing element there are a further plurality of apertures or orifices 44 extending through the rib 42 at an angle to the axis of the sleeve 40 and they merge into the through orifices 41. Interposed between the respective shoulders 43 and 16 is a gasket 45.

The electrode assembly B consists of a metal conductor 50 surrounded by a ceramic insulator 51. The conductor 50 has a tip 52 projecting beyond the ceramic insulator as in a normal spark plug and a distributor lead connector 53 at the opposite end. The sleeve 30 circumscribes the electrode assembly and is spaced therefrom providing therebetween the fluid flow passage C. The ceramic insulator 51 has an enlarged portion 56 providing respective shoulders 57 and 58. The end of the truncated conical portion 37 of tube 32 bears against shoulder 57. A gasket 59 is inserted between shoulder 58 and an end of the atomizing element F. Apertures 38 in the tube 32 provide fluid flow communication from the interior of tube 30 to the interior of tube 31 which together constitute the previously described passage C. Passage D is defined by the outer surface of sleeve 30, the axial bore 19 in nut 11, the interior surface of portion 33 of tube 32 and continues through apertures 36 therein, through to and between the outer surface of sleeve 31 and axial bore 15 in the main body 10. Liquid flowing through passage D continues through apertures 44 in the atomizing nozzle and merges with gas flowing through passages 41 from passage C and the merged flow of fluids is discharged into the common passage E.

In the preferred form, hydrogen gas flows through passage C during use of the device and water is caused to flow through passage D. The size of apertures 41 and 44 in the atomizing nozzle are arranged relative to one another and are of such size that the water flowing through orifices 41 is atomized by the hydrogen gas flowing through orifices 44.

A cap 60 having a plurality of internal contiguous axial bores of different diameter press-fits on the top of the device in sealing engagement respectively with the outer surface of the electrode, sleeve 30 and an upper end portion of the nut 11. Seals are provided by respective O-rings 61, 62 and 63. Passages 64 and 65 in the cap are connected by way of suitable couplings to lines 66 and 67 for supply of a gas and a liquid respectively to passages C and D. Cap 60 can be held on nut 11 in any convenient manner for example, one or more overcentre clips 70 between the cap 60 and a flange 53A on screw on terminal cap 53.

As clearly illustrated in FIG. 1, the upper end of sleeve 32 bears against the shoulder 20 on the nut and is pressed downwardly thereby against the shoulder 57 on the ceramic electrode assembly. This holds the electrode assembly in place, pressing it downwardly against the fuel atomizer or annular element F which in turn has the sloped surface 43 pressed against shoulder 16 of the body and between which is located the gasket 45.

The foregoing combination fuel injector and ignitor is intended as a replacement for spark plugs in an ordinary internal combustion engine. Fuel is fed by way of inlet passages 64 and 65 to respective passages C and D, merging into one by way of the atomizing orifice head F. In the preferred form, a gaseous fuel, such as hydrogen, is fed into the inlet passage 64 and water is fed into inlet passage 65, means being provided upstream therefrom for providing the appropriate amount of each suitably to mix with one another and relative to the power demand. The water flowing in passage D is directed by way of orifices 44, angularly inward into and in the direction of flow of the hydrogen in passages 41 in the atomizing head. The water is atomized by the flowing hydrogen and the mixture carries on through passage E into the combustion chamber of the internal combustion engine. The electrode tip 52 ignites the mixture in a known manner with electric spark being obtained from the electrical distribution system of the engine.

FIG. 3 illustrates an exploded view of the electrode, the sleeves and the atomizing nozzle contained in the body and nut member of the unit.

Figure 4:
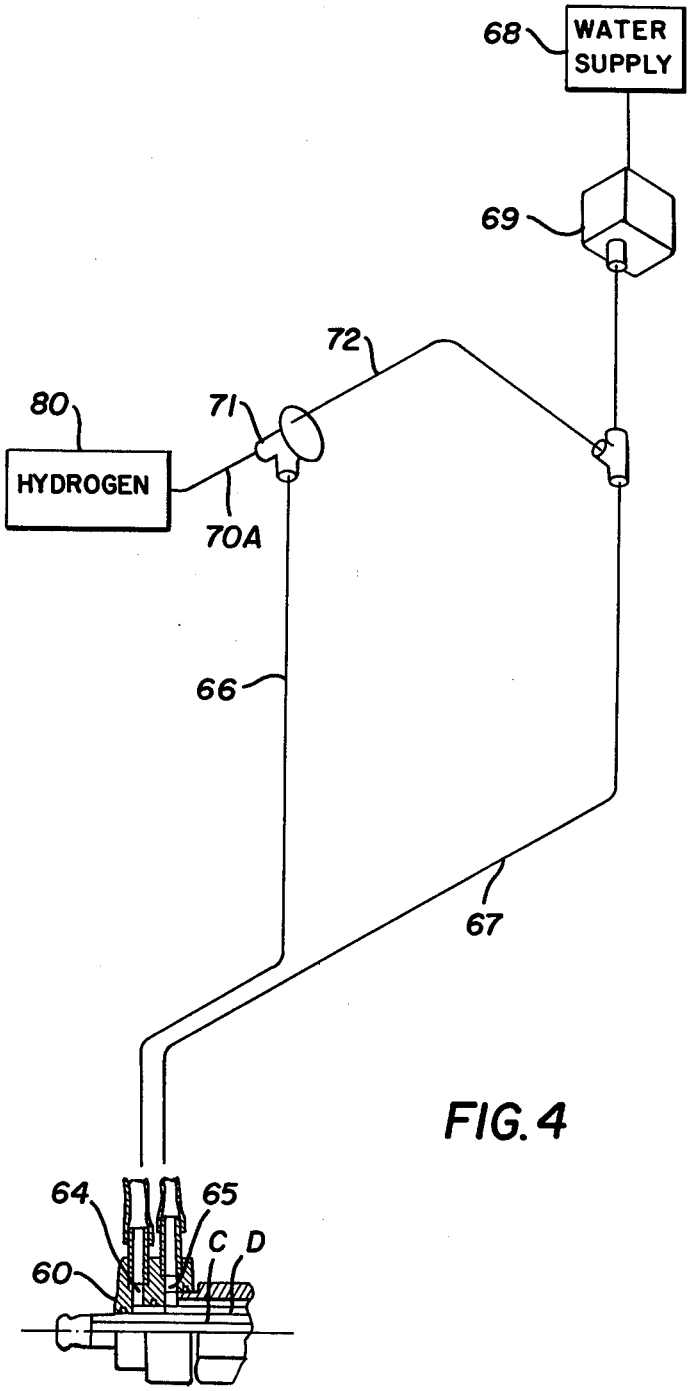
FIG. 4 is a diagrammatic view illustrating the injector and means for supplying fluids thereto for an internal combustion engine; and, FIG. 5 is a detailed sectional view of a control valve mechanism for proportioning the respective fluids for supply to the internal combustion engine.

FIG. 4 diagrammatically illustrates a system for appropriately supplying hydrogen and water to the injector, hydrogen being fed to inlet passage 64 by way of line 66 and water being fed to the inlet passage 65 by way of line 67.

Water from a suitable source 68 is injected into line 67 by an injection pump 69. A conventional injection pump as used on diesel engines could be used or adapted to inject the water. The amount of water injected varies with the effective stroke or the time the pump injects. Hydrogen from a pressurized supply 80 of hydrogen is diverted into line 66 by a diverter valve 71 actuated by water pressure in line 67 by way of a connection thereto by line 72. The pressure of the hydrogen is selected such that it gives the correct amount to match the amount of water injected. The water being injected causes the valve to open and hydrogen will thus flow at the same time. The amount of water is metered by the injection pump 69, i.e., varying the period of flow and this will, in turn, cause the amount of hydrogen to be metered at the same time.

There are, of course, many alternative arrangements for appropriately proportioning the hydrogen and water being injected, for example, a pressure sensing switch could be used in the water injector line and arranged to open a solenoid in the gas line simultaneously to meter the amount of hydrogen relative to the amount of water injected.

In using the foregoing described arrangement in an automobile, the injectors replace the spark plugs and the injection pump has a separate piston for each injector. There also would be one diverter valve 71 for each injector.

Figure 5:
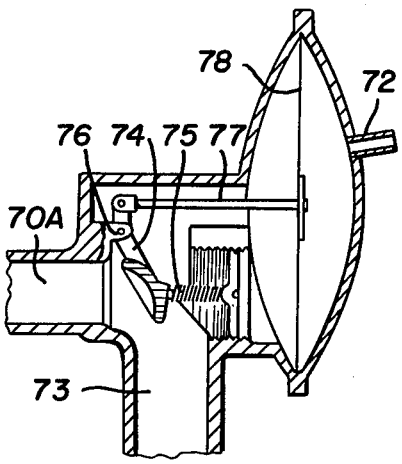

Details of one form of diverter valve that could be used is illustrated in FIG. 5 and includes a gas inlet passage 70A and a gas outlet passage 73 connected respectively to the hydrogen supply 80 and line 66. Flow of hydrogen from passage 70A to passage 73 is controlled by a valve 74 spring-biased to a closed position by a compression spring 75. The valve 74 is pivotally mounted by a pin 76 and a lever arm on the valve is connected by a link 77 to a diaphragm 78. Water under pressure from line 72 acts on the diaphragm 78 to open the valve and thereby allow hydrogen to flow from the inlet 70A to the outlet 73. As previously mentioned, the duration of the injection of water will determine the length of time the valve 74 is open thereby metering the hydrogen in proportion to the amount of water injected, providing the pressure of the hydrogen supply is appropriately set.

The foregoing injector obviously may be used with various fuels, the preferred being hydrogen. The water is mixed with the hydrogen to lower the flame temperature during combustion sufficiently to suppress or eliminate formation of nitrous oxides. The injector can also be used with liquid fuels (in one passage) and compressed air (in the other passage). It is also contemplated one or more additional passages may be provided for mixing various fuels as well as mixing fuels or various fuels with air and/or water.

Back-flow or back-pressure preventing devices should be provided for the fluid flow passages. This can be provided for example by reed valves 100 and 101 for respective apertures 36 and 38. Alternative back-flow preventing means may be associated with the outlets from orifices 41 or one-way flow valves in the inlets 64 and 65.

In the foregoing device the electrode element has an outwardly directed annular rib with shoulders 57 and 58. Shoulder 58 bears against one end of an annular nozzle means having first and second fluid-flow passages therethrough and a portion of such annular element bears against a shoulder on the main body. The tube 32 abuts at one end against an end portion of the nut and at the other end against shoulder 57. The tube 32 is of stepped diameter and has portions traversing the respective first and second concentric fluid-flow passages with the portions traversing the passages being apertured to allow fluid flow through the respective annular passages. The arrangement is such that the nut holds the entire assembly together and such construction is believed novel and unique in itself. It is contemplated the device may have other applications than being a combined fuel injector and fuel ignitor. The electrode may be replaced merely by a rod assembly or a tube in which case the tube would provide a further fluid-flow passage through the central portion of the device.

I claim:

1. An automobile spark plug having a threaded mounting body member, an elongate insulated electrode extending through said body member and terminating in an ignitor tip at one end thereof, first and second concentric annular fluid-flow passageways having different diameters in said body member and surrounding said insulated electrode, and a fluid-flow atomizing means interconnecting said annular fluid-flow passageways with one another at one location and downstream therefrom discharging into a common passage surrounding the electrode adjacent the tip end thereof.

2. A device as defined in claim 1, including a cap detachably mounted on said spark plug, said cap having passages therethrough providing individual inlets to said annular fluid flow passageways.

3. A combination fuel injector and ignitor for an internal combustion engine comprising:

(a) an elongate body member threaded at one end thereof for screwing into a spark plug hole of an internal combustion engine;

(b) an elongate insulated electrode passing centrally through said body member and having an exposed tip portion adjacent said threaded end for igniting fuel in the combustion chamber of the engine and means adjacent the opposite end to connect the electrode to a suitable electrical distribution system for the engine;

(c) first and second concentric annular fluid-flow passageways having different diameters in said body member surrounding said insulated electrode, and having respective first and second individual inlets thereto; and (d) liquid atomizing means connecting said first and second annular fluid-flow passageways with one another and with a further passage in said body member downstream of said annular fluid flow passageways, said further passage surrounding the exposed tip end portion of the insulated electrode, said atomizing means comprising a first array of individual passages and a second array of individual passages communicating respectively with said first and second fluid-flow passages and converging in the direction of fluid flow to mix the fluids flowing from said first and second passages and direct the mixed fluids into said further passage.

4. A device as defined in claim 3, including means for feeding a quantity in selected proportions a liquid and a gas and directing the same respectively to said first and second fluid-flow passageways.

5. A device as defined in claim 4, wherein the quantity of one of the liquid and the gas fed is dependent upon and responsive to the quantity fed of the other of the liquid and the gas.

6. An elongate body having a central bore extending therethrough and threaded at one end thereof for screwing into a threaded hole with an electrode extending centrally therewithin said bore, a central elongate insulating member, smaller in diameter than said bore about said electrode, extending axially through said bore and having an outwardly projecting circumferential rib located within the bore, said rib being spaced from a shoulder in said bore, an annular nozzle means abutting respectively said rib and shoulder and having respective first and second passages, sleeve means in said bore providing two concentric annular fluid-flow passages therethrough and communicating respectively with the first and second passages of said nozzle means, an annular nut threaded into said elongate body at one end thereof opposite said one end and a tube abutting at one end thereof against an end of said nut and at the other end against said rib on the central elongate member, said tube being of stepped diameter and having apertured portions traversing said first and second annular fluid flow passages.

7. A device as defined in claim 6 wherein said central elongate member is a solid member.

8. A device as defined in claim 6 wherein said central elongate member is a tubular member.

9. A device as defined in claim 6 including a cap detachably mounted on said annular nut and having passages therethrough communicating with said respective first and second annular passages.

10. A combination fuel injector and ignitor for an internal combustion engine comprising:

(a) an elongate body member threaded at one end thereof for screwing into a spark plug hole of an internal combustion engine;

(b) an elongate insulated electrode extending longitudinally through said body member and having an exposed tip portion adjacent said threaded end for igniting a fuel mixture injected in the combustion chamber of the engine and means at the opposite end to connect the electrode to a suitable electrical distribution system for the engine; p1 (c) first and second concentric annular fluid-flow passageways having different diameters in said body member surrounding said insulated electrode and having respective first and second individual inlets thereto; and, (d) liquid atomizing means downstream from said inlets connecting said first and second fluid-flow passages with a common passage, said atomizing means comprising a first array and a second array of individual passages spaced circumferentially around the insulated electrode, said common passage having an outlet therefrom into the combustion engine when the injector is threaded into the spark plug hole thereof.

11. A device as defined in claim 10, wherein said body, through which the insulated electrode extends, comprises two detachably interconnected members having a central bore therethrough and in which there are located a plurality of concentric overlapping sleeves of different diameter which together with the bore through said interconnected members and insulated electrode define said first and second passageways.

12. A device as defined in claim 10 wherein said first array of passages and said second array of passages communicate respectively with said first and second annular fluid-flow passageways and converge in the direction of fluid flow to mix the fluids flowing from said first and second passages into said common passage.

13. A device as defined in claim 12, wherein said second fluid flow passageways circumscribes said first fluid flow passageway, wherein said first array of passages are parallel to the axis of the first and second fluid flow passageways and wherein said second array of passages are angularly related thereto sloping inwardly toward the central axis of the device in the direction of flow.

14. A device as defined in claim 13, wherein said first and second array of passages merge into one another upstream of said common passage.

* * * * *